United States Patent [19]

Audeh et al.

[11] 4,161,442

[45] Jul. 17, 1979

[54] PROCESSING OF TAR SANDS

[75] Inventors: Costandi A. Audeh, Princeton; Nai Y. Chen, Titusville, both of N.J.

[73] Assignee: Mobil Oil Corporation, New York, N.Y.

[21] Appl. No.: 867,061

[22] Filed: Jan. 5, 1978

[51] Int. Cl.[2] ..... C10G 1/00; C10J 3/06

[52] U.S. Cl. ..... 208/11 R; 48/197 R

[58] Field of Search ..... 208/11 R; 48/197 R

[56] References Cited

U.S. PATENT DOCUMENTS

| | | | |
|---|---|---|---|
| 2,474,345 | 6/1949 | Clark et al. | 208/11 R |
| 3,503,869 | 3/1970 | Haddad et al. | 208/11 R |
| 3,691,056 | 9/1972 | Barney et al. | 208/11 R |
| 3,784,462 | 1/1974 | Frick | 208/11 R |
| 3,960,702 | 6/1976 | Allred | 208/11 R |
| 4,058,205 | 11/1977 | Reed, Jr. | 208/11 R X |

FOREIGN PATENT DOCUMENTS

| | | | |
|---|---|---|---|
| 736453 | 6/1966 | Canada | 208/11 |

*Primary Examiner*—Delbert E. Gantz
*Assistant Examiner*—William G. Wright
*Attorney, Agent, or Firm*—Charles A. Huggett; Carl D. Farnsworth

[57] ABSTRACT

Petroliferous material of tar sands is processed to recover material boiling below 850° F. with higher boiling material converted to high BTU fuel gas and with heat developed transported to improve the thermal efficiency of the combination operation.

12 Claims, 1 Drawing Figure

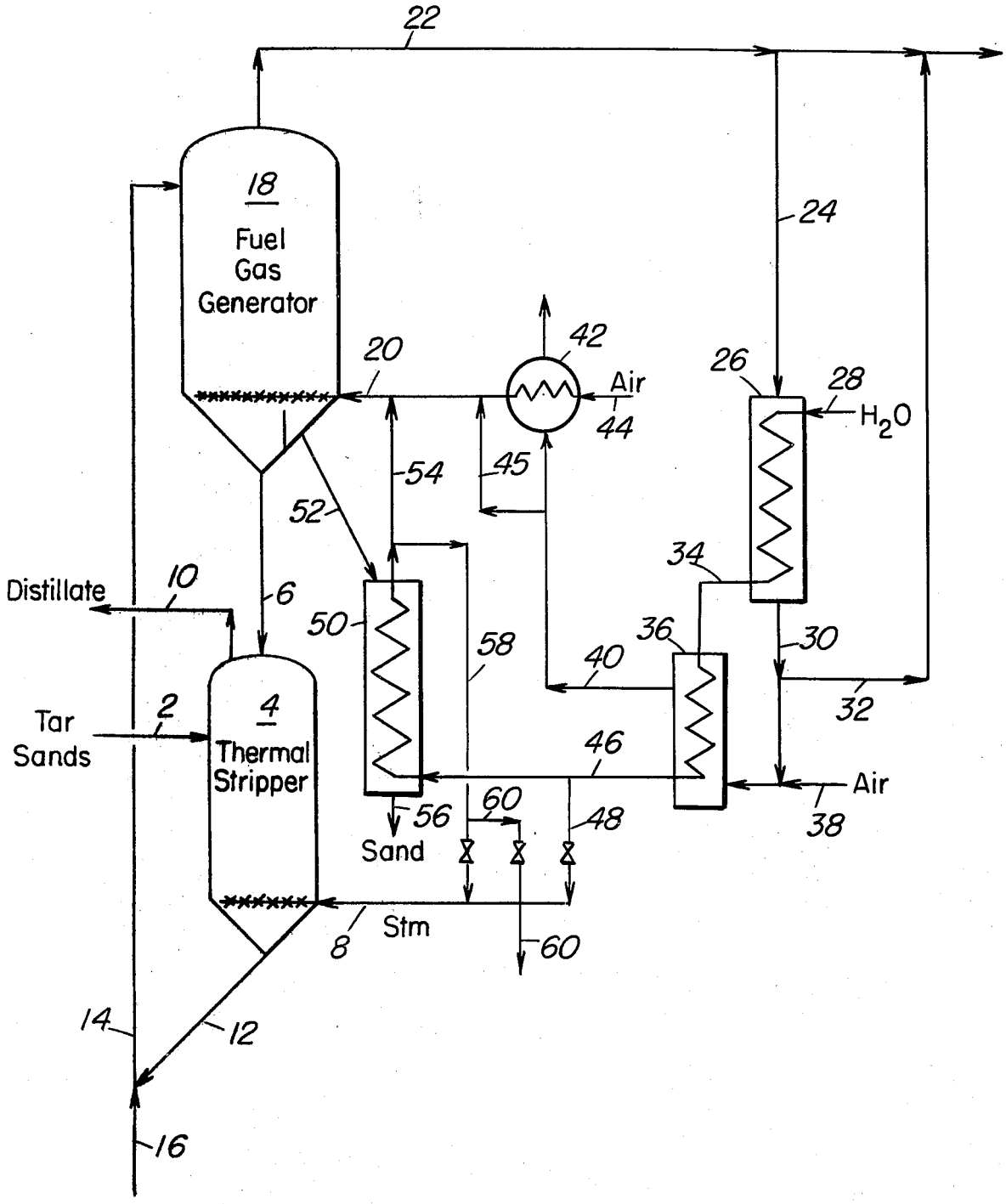
22
18
Fuel
Gas
Generator
24
42
20
Air
44
26
28
$H_2O$
54
45
52
34
Distillate
10
6
50
58
36
30
40
32
Tar
Sands
2
4
Thermal
Stripper
46
Air
38
56
60
48
Sand
Stm
8
60
14
12
16

PROCESSING OF TAR SANDS

BACKGROUND OF THE INVENTION

Tar sands, also known as oil sands and bituminous sands, are siliceous materials impregnated with petroliferous material convertible to petroleum products. The largest and most important deposits of the sands are the Athabasca sands found in northern Alberta, Canada. These sands underlay more than 13,000 square miles at a depth of 0 to 2,000 feet. The tar sands are primarily silica, closely associated with petroliferous material (heavy oily material) which varies from about 5 to about 21 percent by weight, with a typical content of 13 weight percent comprising the sand. The oil is quite heavy, 6° to 8° API gravity and contains typically 4.5 percent sulfur and about 38 percent aromatics. The sands include clay and silt in quantities of from 1 to 50 weight percent (more usually 10 to 30 percent) and water in quantities of 1 to 10 percent by weight. The recovery of oily product from the tar sand has been pursued by a "cold water process", a "hot water process" as well as by retort methods which are akin to thermal cracking or pyrolysis techiques as used to process oil shale. A thermal method of recovering bitumen by direct retorting has been studied since 1940. In direct retorting, the raw oil sand is contacted with spent sand and fluidized by reactor off gas at a temperature above 900° F. The volatile products are flashed while 6–7 weight percent of coke (based on bitumen) is deposited via thermal cracking. The coked sand is burned off in a separate unit at 1200–1400° F. and recirculated. The voluminous amount of spent sand needed, i.e., 5–10 parts per part of cold tar sand, for the process necessitates a very large retort volume per barrel of recoverable oil. Such methods obviously are expensive and of little interest. Serious waste heat and handling problems arise with this process.

The present invention is concerned with a combination process which embodies the technique of low temperature distillation of bitumen in the presence of recycled hot sand particles acquired from a fuel gas generation zone processing sand with residue material of the distillation operation.

The processing of sand comprising residual oil or residue hydrocarbonaceous material recovered from the distillation operation is accomplished under high temperature conditions in the presence of oxygen rich gas and steam to produce particularly fuel gas. Thus, the reactions that occur in the gasification of the hydrocarbonaceous material include thermal cracking and a number of different reactions, such as:

(1) $C+O_2 \rightarrow CO_2$
(2) $C+CO_2 \rightarrow 2CO$
(3) $C+H_2O \rightarrow CO+H_2$
(4) $C+2H_2 \rightarrow CH_4$
(5) $CO+H_2O \rightarrow CO_2+H_2$
(6) $H_2+\frac{1}{2}O_2 \rightarrow H_2O$ The oxidation of carbon, reaction (1) is highly exothermic. Gasification processes use partial oxidation of char with either air or oxygen to provide heat for the endothermic reactions of (2) and (3). These reactions comprising the gasification of char with $CO_2$ and the water gas reaction (3) are thermodynamically favored at temperatures above 1350° F. The methanation reaction (4) is highly exothermic and is thermodynamically favored at temperatures less than 1150° F. The water gas shift reaction (5) is mildly exothermic with favorable equilibrium below 1350° F. It is recognized by those skilled in the art that the composition of the produced fuel gas may be varied with pressure and temperature. That is, by raising the pressure and lowering the temperature, the methane yield may be increased. On the other hand, fuel gas of at least 120 BTU/SCF does not necessarily require the presence of large amounts of methane.

SUMMARY OF THE INVENTION

The present invention is concerned with a process for treating tar sands. The invention particularly relates to a combination process embodying the techniques of low temperature distillation under conditions minimizing cracking and gasification of a distilled oil product and the conversion of residual hydrocarbonaceous material to produce fuel gas and generate transportable heat contributing measurably to the thermal efficiency of the operation. More particularly, the present invention is concerned with mixing high temperature solids comprising silica with tar sands in a thermal stripping operation restricted not to materially exceed incipient cracking of petroliferous material by limiting the operating temperature to within the range of 600° F. to 850° F. and preferably below 800° F. Thus, the amount of hot spent sand required to distill the oil is of a relatively low magnitude of no more than 5 parts of spent hot sand per part of tar sand and preferably within the range of 0.6 to 2 parts per part of tar sand and this relatively low ratio of spent sand to fresh tar sand significantly reduces the solids handling problems while achieving desired fluid distillation and production of an oil product. Furthermore, since the fluid distillation is operated to minimize cracking, the concentration of hydrocarbonaceous residue or residual oily material on the sand is relatively high, such as, 2 percent and higher for some particles. This high oily residue or hydrocarbonaceous material containing sand is used to generate 120 and higher BTU/SCF fuel gas, a very desirable product. The addition of steam and air when heating the sand with hydrocarbonaceous residue to a temperature above 1500° F. produces the fuel gas desired and its composition may be varied by using oxygen enriched gas to produce the higher BTU gas. High temperature sand recovered from the gasification of hydrocarbonaceous material and the fuel gas product are used to generate hot streams of air and steam used not only in the process but also to generate electricity.

DISCUSSION OF SPECIFIC EMBODIMENT

Referring now to the drawing by way of example, tar sands comprising petroliferous material in the range of about 5 to 21 weight percent and more usually less than 15 percent by weight is charged to the processing combination of this invention by conduit 2 to a thermal stripping zone 4 maintained at a temperature within the range of about 600 to 850° F. and more usually in the range of 700° to 800° F. The pressure of stripper 4 may be in the range of atmospheric pressure up to about 100 pounds pressure. More usually, the pressure is below 60 pounds. In stripping zone 4, sometimes referred to herein as a distillation zone, the introduced tar sands are mixed with hot sand particles in a ratio of less than 5 parts of recycled hot sand per part of tar sands introduced by conduit 6. In addition, stripping steam introduced to the lower portion of the stripping zone at an elevated temperature by conduit 8 is generally restricted to a range of 5 to 10 percent by weight of the hydrocarbon charged. Thus, the temperature profile desired within the stripping zone is maintained substantially by the hot sand recycled thereto along with the stripping steam charged to the bottom of the stripper. The hydrocarbon product of distillation is recovered from the upper portion of the distillation zone by conduit 10. Generally speaking, it is preferred to recover by the distallation step all of the hydrocarbon material recoverable in the absence of significant thermal cracking or at temperatures of incipient cracking and below. A sand product comprising residual oily material or hydrocarbonaceous material is withdrawn from the bottom of stripper 4 by conduit 12 and charged to a lift conduit 14. A suitable lift gas such as flue gas, steam or fuel gas products of the combination operation and combinations thereof may be charged to the bottom of lift conduit or riser 14 by conduit 16. The lift gas employed is preferably at an elevated temperature sufficient to avoid cooling of the solids comprising sand with carbonaceous material deposits of the distillation operation. The lift gas forms a suspension with the solids and conveys the solids through the riser for discharge in the upper portion of a fuel gas generator 18.

In gas generator 18, the solids which are primarily silica with hydrocarbonaceous material residue of distillation pass generally downward countercurrent to a gaseous mixture of steam and air introduced at an elevated temperature within the range of 1000° F. to about 2000° F. by conduit 20 to the lower portion of gas generator 18. Gas generator 18 is operated at a temperature within the range of about 1500° F. to about 2200° F. It is intended that the gas generator be operated at a pressure within the range of atmospheric pressure up to several hundred pounds. A particularly desirable pressure range of about 60 pounds up to about 100 pounds and under conditions producing 120 and higher BTU fuel gas suitable for use in power generation is most useful. The fuel gas will comprise a mixture of hydrogen, carbon monoxide, carbon dioxide and methane. In generator 18, the solids passed thereto and comprising particles of silica with hydrocarbonaceous residual material are heated to an elevated temperature within the range of 1500° to 2000° F. by combustion of the carbonaceous material with air or an oxygen enriched gas to form CO and $CO_2$. The presence of added steam promotes other known reactions hereinbefore identified and forming the fuel gas composition of at least 120 BTU/SCF. A portion of the sand particles heated in the gas generator 18 is withdrawn as by conduit 6 for passage to and use in the thermal stripping zone 4, as discussed above. Another portion of the hot sand particles is recovered for use as hereinafter discussed.

The fuel gas generated in zone 18 is recovered therefrom by conduit 22 at an elevated temperature within the range of about 1500° to about 2000° F. All or a portion of this recovered hot fuel gas is passed by conduit 24 to indirect heat exchanger 26. In exchanger 26, the hot fuel gas indirectly preheats water charged thereto by conduit 28. Cooled fuel gas is recovered from exchanger 26 by conduit 30 and a portion thereof is passed by conduit 32 for recovery and/or admixture with fuel gas in conduit 22. The water preheated in heat exchanger 26 is recovered and passed by conduit 34 to a second heat exchange zone 36 wherein further heating of the preheated water is accomplished by combustion products of burning fuel gas in zone 36. That is, a portion of the fuel gas in conduit 30 is mixed with air or other suitable oxygen containing gas in conduit 38 and combusted in indirect heat exchanger 36. Gaseous products of combustion are recovered by conduit 40 from zone 36 and may be used in indirect heat exchanger 42 to preheat air charged by conduit 44 thereto or gaseous products in 40 may be passed by conduit 45 for direct mixing with air in conduit 20. The preheated air may be further heated by partial combustion in a zone not shown and/or hot combustion products may be combined with additional oxygen containing gas such as air and charged to the bottom portion of generator 18 by conduit 20. A steam product is recovered from fired heat exchanger 36 by conduit 46 at an elevated pressure within the range of 500 to 1000 psig.

This steam product in conduit 46 may be charged directly to the lower portion of stripping zone 4 by conduit 48 communicating with conduit 8 or further heating of all or a portion of this steam stream may be accomplished as follows. That is, steam in conduit 46 may be passed to zone 50 to which hot solids are passed by conduit 52 from gas generator 18. In zone 50, the steam in conduit 46 directly or indirectly contacts the hot solids and is heated to an elevated temperature sufficient to be passed directly by conduit 54 to the lower portion of generator 18 in combination with air preheated as above described. Sand thus cooled is withdrawn from zone 50 by conduit 56. It is contemplated using partially cooled sand recovered from zone 50 to preheat air charged to either one or both of zone 18 or zone 36. It is also contemplated passing a portion of the super heated steam recovered from zone 50 by conduit 54 to stripper 4 by conduit 58 communicating between conduits 54 and 8. On the other hand, all or a portion of the steam in conduit 58 may be passed by conduit 60 to a steam turbine not shown for electric power generation.

The processing combination of this invention is unusually novel in the many different arrangements of heat recovery and the utilization of that recovered heat in the operation. Furthermore, the lower temperature distillation operation permits a substantial reduction in solids handling and the recovery of distillate product closely resembling straight run petroleum products suitable for use as feed material to hydrocracking, fluid catalytic cracking, and/or the product may be hydrogenated and desulfurized in downstream operations not shown to produce particularly No. 2 fuel oil. Thus, the combination operation of this invention substantially maximizes the recovery of valuable energy from a heretofore unpopular charge material by particularly producing fuel oil, high BTU gas product, electric power and heat transport within the combination contributing substantially to its operating efficiency.

It is recognized that a number of different known systems may be substituted for either one or both of the fuel gas generator or the thermal stripper above discussed and it is intended that such variations may be a part of the combination above discussed without departing from the scope of this invention. In addition, it is recognized that the drawing may be rearranged to place the stripper above the generator, however, there are certain inherent advantages associated with flowing the hottest solids by gravity and the cooler solids with carbonaceous material thereon by lift conduit means. However, in the event that the solids recovered from the stripper are somewhat tacky, it is contemplated adding some hot solids to the tacky mixture before conveying the tacky solids through transfer conduit means. For example, some of the sand in conduit 56 still at a relatively high temperature may be mixed with the solids in conduit 12.

We claim:

1. A method for upgrading tar sands which comprises:

mixing the equivalent of 1 part of tar sands with up to about 5 parts of spent hot sand obtained as defined below to form a mixture therein in a distillation zone at a temperature within the range of 600° to 850° F., stripping petroliferous material from said hot mixture in said distillation zone with steam under conditions avoiding significant cracking to produce an oil distillate product, recovering said oil distillate product, passing sand particles comprising hydrocarbonaceous deposits obtained from said distillation zone to a fuel gas generation zone, contacting said sand particles comprising hydrocarbonaceous deposits in said fuel gas generation zone with a mixture of steam and oxygen containing gas at a temperature within the range of 1500° to 2200° F. and recovering a fuel gas product therefrom, and passing hot sand particles recovered from said fuel gas generation zone at an elevated temperature to said distillation zone for admixture with tar sands as above identified.

2. The method of claim 1 wherein hot sand particles are passed by gravity from said fuel gas generation zone to said distillation zone.

3. The method of claim 1 wherein sand comprising hydrocarbonaceous material is recovered from said distillation zone and is conveyed with lift gas through a riser zone to said fuel gas generation zone.

4. The method of claim 1 wherein hot fuel gas recovered from said fuel gas generation zone is used indirectly to form steam for use in said fuel gas generation zone and said distillation zone.

5. The method of claim 1 wherein a portion of the fuel gas generated is burned in a steam generation zone and the combustion products thereof are combined with a steam air mixture passed to said fuel gas generation zone.

6. The method of claim 1 wherein hot sand particles recovered from said fuel gas generation zone are relied upon to further heat steam formed in a partial combustion zone and steam thus formed is passed to each of said distillation zones and said fuel gas generation zone.

7. The method of claim 1 wherein the pressure of said fuel gas generation zone and said distillation zone is above atmospheric pressure.

8. The method of claim 6 wherein steam recovered from said hot sand contact step is relied upon to generate electricity.

9. The method of claim 1 wherein fuel gas recovered from said fuel gas generation zone is passed in indirect heat exchange with water to heat said water, thereafter the fuel gas is combusted in a zone through which the heated water is indirectly passed to form steam therefrom, a portion of the steam thus formed is passed in heat exchange relationship with hot said particles recovered from the fuel gas generation zone at a temperature above 1500° F. to form super-heated steam, and super-heated steam thus generated is used in each of said fuel gas generation zones and said distillation zone.

10. The method of claim 1 wherein the distillation zone may be either above or below the fuel gas generation zone.

11. A method for recovering an oil product from tar sands which comprises, thermally stripping tar sands in a distillation zone with hot spent sand particles and steam at a temperature restricted to within the range of 600° to 850° F., thereby leaving a substantial amount of residual hydrocarbonaceous material on said thermally stripped sand particles, contacting said thermally stripped sand particles in a fuel gas generation zone with a gaseous mixture of steam and air introduced at a temperature within the range of 1000° to 2000° F. and maintained under pressure conditions permitting the recovery of fuel gas of at least 120 BTU/SCF therefrom, recovering hot sand particles from said fuel gas generation zone and recycling a portion thereof to said thermal distillation zone, and forming hot streams of steam and air by indirect heat exchange with fuel gas product and hot sand particles of the fuel gas generation zone.

12. In a thermal retorting process for recovering an oil product from tar sands by contacting raw oil or bituminous sand with hot spent sand at an elevated cracking temperature, thereby depositing coke on the sand subsequently removed by burning in a separate zone to produce hot sand particles suitable for recycle to said thermal retorting process, the method for improving the thermal retorting process at least with respect to the recovery and transfer of heat generated, the amount of hot spent sand recycled to the operation and the product slate recovered therefrom which comprises, effecting an elevated temperature steam stripping of raw oil sand in the presence of recycled hot spent sand particles at a temperature less than 850° F. and recovering an oil product of said stripping operation boiling below 850° F., recovering a sand product of said thermal stripping comprising at least 2 percent residue hydrocarbonaceous material, processing said sand with residue hydrocarbonaceous material at a temperature of at least 1500° F. in the presence of oxygen-rich gas and steam to produce a fuel gas of at least 120 BTU/SCF, recovering high temperature sand particles following gasification of said residue hydrocarbonaceous material, passing high temperature sand thus recovered to said thermal stripping step, and using high temperature sand particles recovered from said gasification operation and produced fuel gas to generate hot streams of air and steam thereafter recycled to the gasification step and the thermal stripping step as required.

* * * * *